US006282720B1

(12) United States Patent
Mayer

(10) Patent No.: US 6,282,720 B1
(45) Date of Patent: Sep. 4, 2001

(54) UNDER/OUTER SHIRTS/COVERS FOR WOMEN

(76) Inventor: Judy A. Mayer, 13842 180th Ave. SE., Renton, WA (US) 98059

( * ) Notice: Subject to any disclaimer, the term of this patent is extended or adjusted under 35 U.S.C. 154(b) by 0 days.

(21) Appl. No.: 09/686,201

(22) Filed: Oct. 10, 2000

(51) Int. Cl.[7] ..... A41B 9/06; A41D 27/10

(52) U.S. Cl. ..... 2/113; 2/125

(58) Field of Search ..... 2/113, 114, 115, 2/120, 125, 126, 53, 54, 55, 56, 58, 59; D2/774, 800, 717

(56) References Cited

U.S. PATENT DOCUMENTS

| | | | | |
|---|---|---|---|---|
| D. 129,023 | * | 8/1941 | Regenburg . | |
| D. 141,583 | * | 6/1945 | Walker | D3/26 |
| D. 306,230 | * | 2/1990 | Nigro | D2/220 |
| 1,157,265 | * | 10/1915 | Tutelman . | |
| 1,477,218 | * | 12/1923 | Guinzburg . | |
| 2,466,887 | * | 4/1949 | Fried | 2/125 |
| 3,421,514 | * | 1/1969 | Friedlander . | |
| 3,508,279 | * | 4/1970 | Ayoub | 2/113 |
| 4,501,025 | * | 2/1985 | Kuznetz | 2/243 |
| 4,541,129 | * | 9/1985 | Murkami | 2/113 |
| 5,014,360 | * | 5/1991 | Smith et al. | 2/115 |
| 5,042,089 | * | 8/1991 | Carmer | 2/55 |
| 5,070,542 | * | 12/1991 | LaVelle et al. | 2/129 |
| 5,090,060 | * | 2/1992 | Gates | 2/115 |
| 5,371,904 | * | 12/1994 | McEwen | 2/129 |
| 5,864,889 | * | 2/1999 | Suffern | 2/247 |
| 6,148,445 | * | 11/2000 | Spruill | 2/125 |
| 6,183,339 | * | 2/2000 | Thompson | 450/1 |

* cited by examiner

*Primary Examiner*—John J. Calvert
*Assistant Examiner*—Alissa L. Hoey
(74) *Attorney, Agent, or Firm*—Delbert J. Barnar

(57) ABSTRACT

A shirt (10) or upper cover comprises a torso enclosure (14) and sleeves (16, 18). The sleeves (16, 18) have short top lengths (TL) and long bottom lengths (BL). The sleeve seams (20, 22) extend over the clavicle/acromin regions of the wearer (12) of the shirt (10). Top regions (30, 32) of the torso enclosure (14) and the tops (34, 36) of the sleeves (16, 18) follow the curvature of the shoulder substantially above the shoulder joints. The bottoms of the sleeves fold upwardly into the armpits of the wearer (12), providing perspiration absorbing cloth against skin regions of the torso and the arms.

21 Claims, 8 Drawing Sheets

FIG. 10
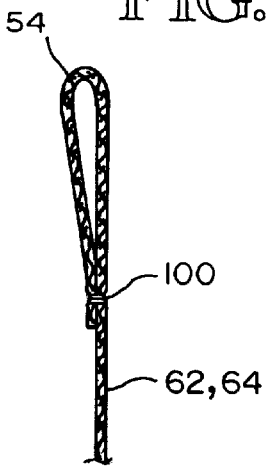
FIG. 11
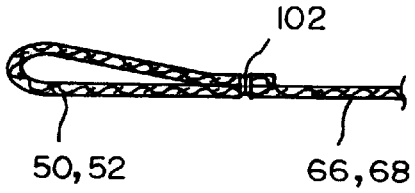
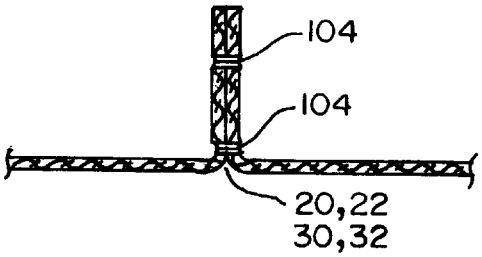
FIG. 12
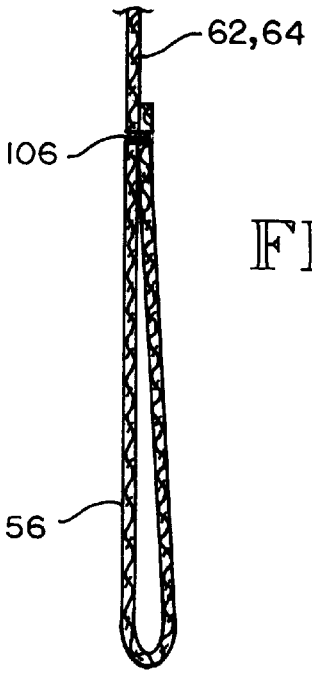
FIG. 13

UNDER/OUTER SHIRTS/COVERS FOR WOMEN

DESCRIPTION

1. Technical Field

This invention relates to under/outer shirts, or upper covers, for women. More particularly, it relates to undershirts, outer shirts and upper covers for women of a type having sleeves that are short at the top and full under the arms and capable of functioning as shields for absorbing underarm perspiration.

2. Background of the Invention

Men have for some time worn T-shirts under dress shirts, sweaters and other outer shirts, for absorbing perspiration and shielding the outerwear against direct contact with the perspiration. Women find a shirt constructed like a man's T-shirt to be unacceptable for several reasons. If such a shirt were to be used as an undershirt, the sleeves might show through the outer garment, and/or at the neck and sleeve openings of the outer garments, and/or provide bulk under the outer garment that shapes the outer garment in an undesirable way. Also, men's T-shirts are made from a relatively heavy fabric. Women prefer clothing made from light fabric. There is a need for a women's T-shirt that will shield outer garments from underarm perspiration without adversely affecting the appearance of the outer garment. There is also a need for a women's T-shirt that is attractive when used as an outer garment itself while functioning to absorb underarm perspiration. It is an object of the present invention to fulfill these needs.

BRIEF SUMMARY OF THE INVENTION

The T-shirt of the present invention is basically characterized by a fabric torso enclosure and a pair of fabric sleeves, each having inner and outer end openings. The torso enclosure has a top, a neck opening in the top, a bottom including a waist opening, and a pair of arm openings at upper side locations. Seams connect the inner end openings of the sleeves to the torso enclosure at the arm openings. The seams are positioned to extend over the clavicle/acromin regions of a wearer of the shirt. Each sleeve has a top length measured from the seam to the sleeve outer end opening at the top of the sleeve, and a bottom length, measured from the seam to the sleeve outer end opening at the bottom of the sleeve. The bottom length of the sleeve is longer than the top length of the sleeve. The sleeves provide perspiration absorbing fabric contiguous both armpits of the wearer. Preferably, at least the sleeve fabric is one hundred percent (100%) combed cotton. Preferably also, it is $\frac{2}{8}^{th}$ cut ring spun jersey.

Preferably, the sleeve top length is about zero to three inches (0–3") and the sleeve bottom length is about three to six inches (3–6"). In a preferred embodiment, the neck opening has a neckline in the front with a drop of about eight to ten inches (8–10"). The neck opening has a neckline in the back with a drop of about two to three inches (2–3").

In a preferred embodiment, the width of the top of the torso enclosure between each seam and the neck opening, on each side of the neck opening is about one and three quarters inches to about two and one half inches (1¾–2½"). In a preferred embodiment, this top width is combined with sleeves having a top length of about one and three quarters inches (1¾") and a bottom length of about three and one half inches (3½"), and with a neck opening having a neckline in the front with a drop of about eight to ten inches (8–10").

Herein, "upper cover" includes a sports bra or similar wear having a short torso cover and a raised bottom.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

Like reference numerals are used to designate like parts throughout the several views of the drawing, and:

FIG. 10 is a sectional view taken substantially along lines 10—10 of FIG. 5, showing the neck hem in section;

FIG. 11 is a sectional view taken substantially along lines 11—11 of FIG. 5, showing the sleeve hems in section;

FIG. 12 is a view taken substantially along line 12—12 of FIG. 5, showing the sleeve seams and the body top and side seams in section;

FIG. 13 is a view taken substantially along line 13—13 of FIG. 5, showing the bottom hem in section;

DETAILED DESCRIPTION OF THE INVENTION

Figure 1:
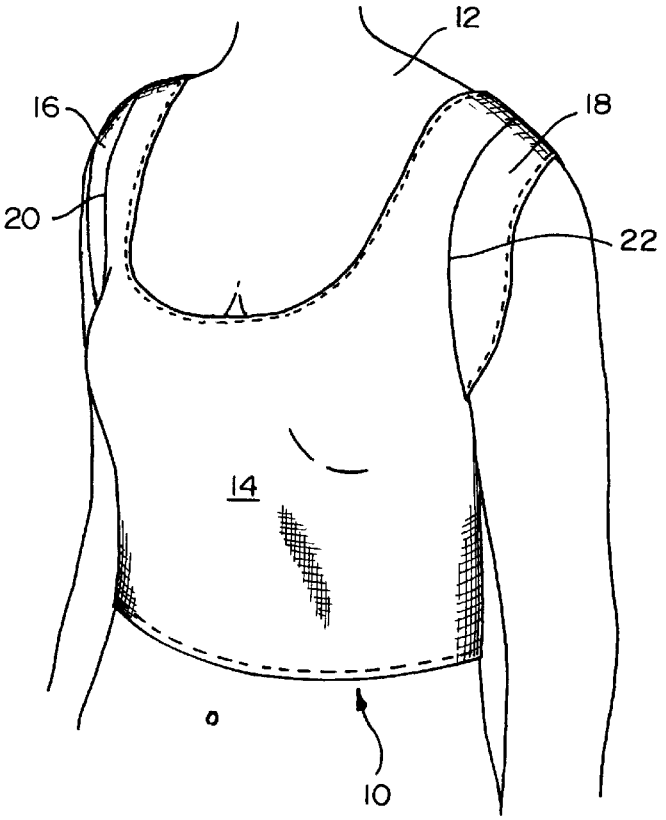
FIG. 1 is a pictorial view taken from above and looking towards the front and one side of the torso and upper arm regions of a person, shown wearing a T-shirt that embodies the present invention.
Figure 2:
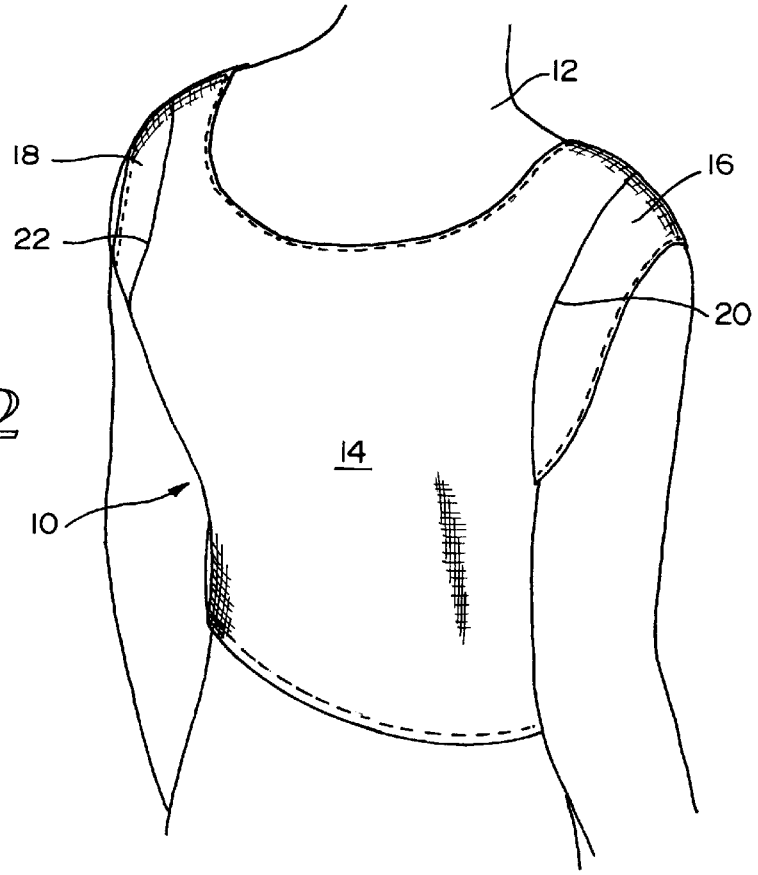
FIG. 2 is a pictorial view taken from above and looking towards the back and the opposite side of the torso and upper arm regions of the person shown in FIG. 1, showing the appearance of the T-shirt from the rear.

FIGS. 1–4 show a shirt 10 embodying the present invention on a person 12. Shirt 10 has a fabric torso enclosure 14 and a pair of fabric sleeves 16, 18, each having inner and outer end openings. Seams 20, 22 connect the inner end openings of the sleeves 16, 18 to the torso enclosure 14 at the arm openings. The outer end openings of the sleeves 16, 18 are designated 24, 26.

Shirt 10 includes a neck opening 28 that is horizontally between torso top parts 30, 32. The sleeve tops 34, 36 extend laterally outwardly from the torso tops 30, 32. In the preferred embodiment, there are no seams in regions 34, 36. Sleeve bottoms 38, 40 include seams 42, 44. Parts 30, 32 include top seams 46, 48. As shown by FIG. 12, seams 20, 22, 42, 44, 46, 48 are substantially identical. The outer ends 24, 26 of the sleeve 16, 18 include hems 50, 52. The neck opening 28 includes a hem 54. The torso bottom opening includes a hem 56. These seams 20, 22, 42, 44, 46, 48 and hems 50, 52, 54, 56 will hereinafter be described in greater detail.

Figure 7:
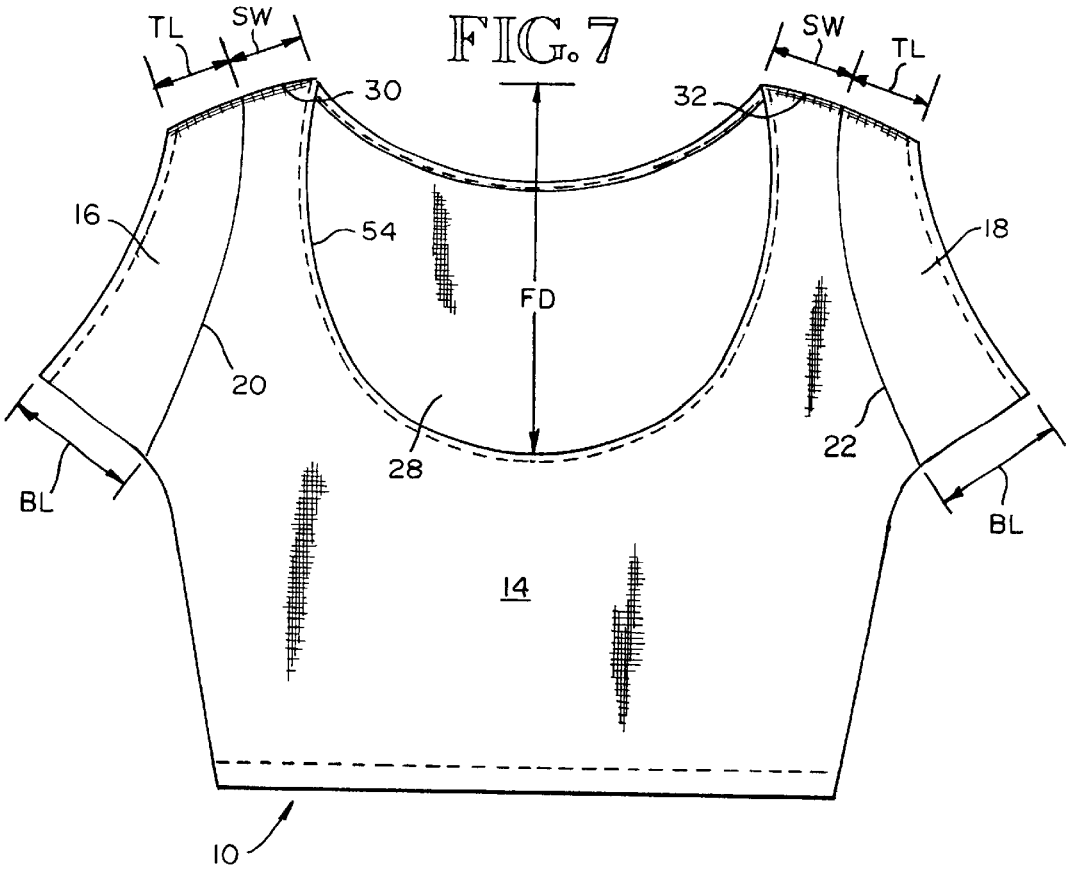
FIG. 7 is a view like FIG. 5, but including dimensioned lines.

As best shown by FIG. 7, each sleeve 16, 18 has a top length TL measured from the seams 20, 22 to the sleeve outer end openings 24, 26 at the top of the sleeve 20, 22. Each sleeve 16, 18 also has a bottom length BL measured from the seam 20, 22 to the sleeve outer end opening 24, 26 at the bottom of the sleeve 20, 22. In each embodiment of the invention, the bottom length BL is longer than the top length TL. Preferably, the top length TL is about zero to three inches (0 to 3"). The bottom length BL is about three to six inches (3–6").

Figure 8:
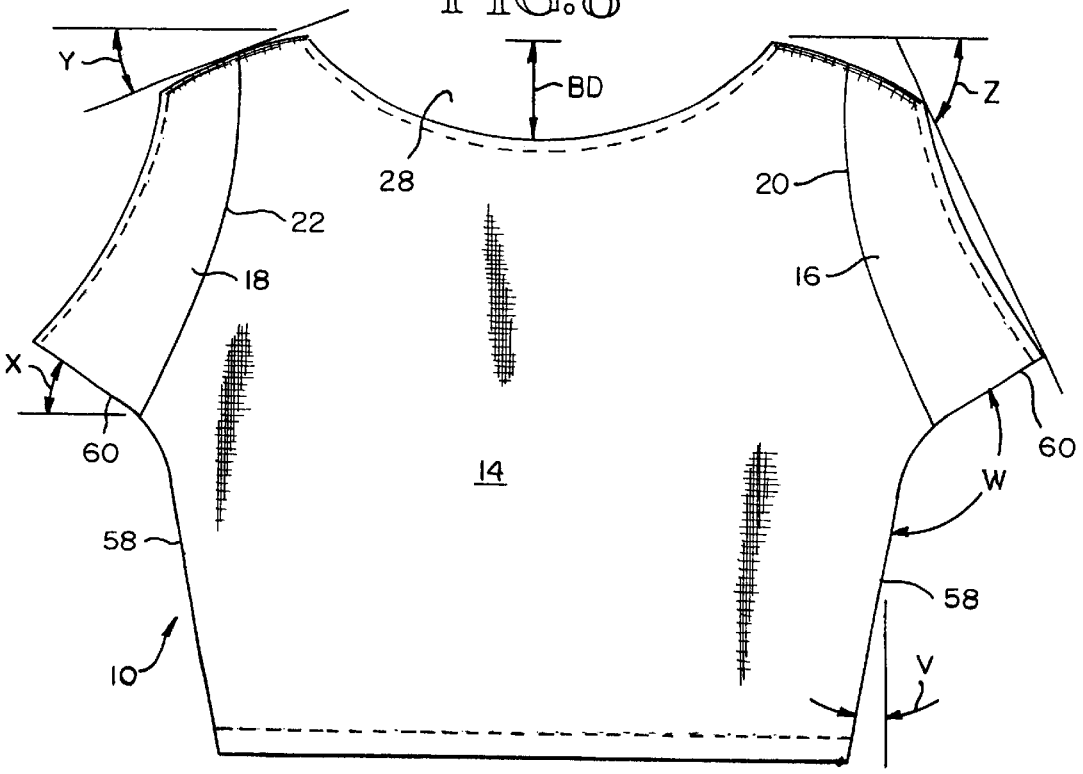
FIG. 8 is a view like FIG. 6, but identifying angles that are important.

In preferred form, the neck opening 28 has a neckline in the front with a drop FD (FIG. 7) of about eight to ten inches (8–10") and a drop BD (FIG. 8) in the back of about two to three inches (2–3"). This allows the shirt 10 to be worn under a blouse, dress, etc. that has a neck opening that is both wide and deep. At its sides, the torso enclosure 10 leans outwardly an angle V which in FIG. 8 is shown to be fifteen degrees (15°). The angle W between the sideline 58 of the torso 10 and the bottom lines 60 of the sleeves 16, 18 is an obtuse angle, shown in FIG. 8 to be about one hundred and thirty degrees (130°). The bottom lines 60 of the sleeves 16, 18 slope upwardly from horizontal by an angle X that is shown in FIG. 8 to be about thirty-five degrees (35°). At the top of the torso enclosure 10, the torso top parts 30, 32 slope and curve outwardly and downwardly together with the top seams of the sleeves 16, 18. A tangent line slopes downwardly from horizontal by an angle Y, shown in FIG. 8 to be about twenty-five degrees (25°). The outer end openings 50, 52 of the sleeves 16, 18 are defined by concave edges. The angle z between a chordline at the outer edges and horizontal is an acute angle, shown to be about sixty-five degrees (65°).

The angles V, W, X, Y, Z can vary to some extent. For example, angle V can vary between substantially about zero degrees (0°) and substantially about twenty degrees (20°). Angle W can vary from about one hundred and eighteen degrees (118°) to about one hundred thirty-two degrees (132°). Angle X can vary between substantially about twenty-eight degrees (28°) to substantially about thirty-eight degrees (38°). Angle Y may be substantially about twenty-two degrees (22°) to substantially about twenty-eight degrees (28°). Angle Z may be substantially about sixty degrees (60°) to substantially about seventy degrees (70°).

The downward and inward slope of the torso side lines 58 and the upward and outward slope of the bottom lines 60 of the sleeves 16, 18 are important because they reduce bulk under the outer garment. The shirt 14 should provide a tapered fit corresponding to the natural taper of the torso. Larger sizes have a smaller degree of taper but preferably also conform to the torso of the wearer.

Figure 3:
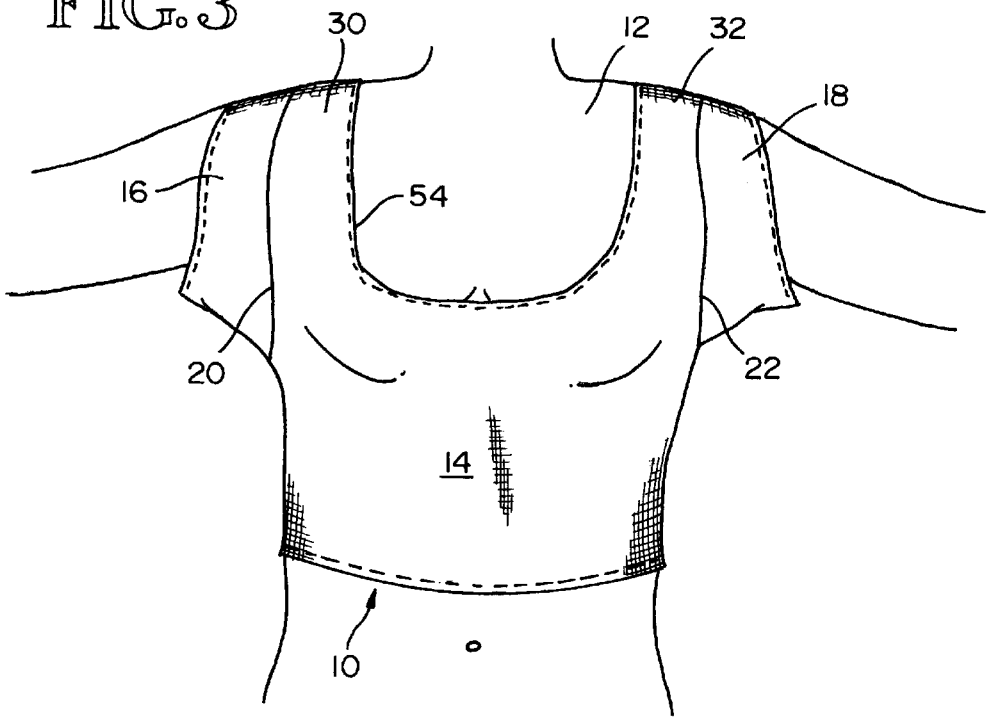
FIG. 3 is a front elevational view of the torso and upper arm regions of the person shown in FIGS. 1 and 2, but with her arms substantially straight out at her sides.
Figure 4:
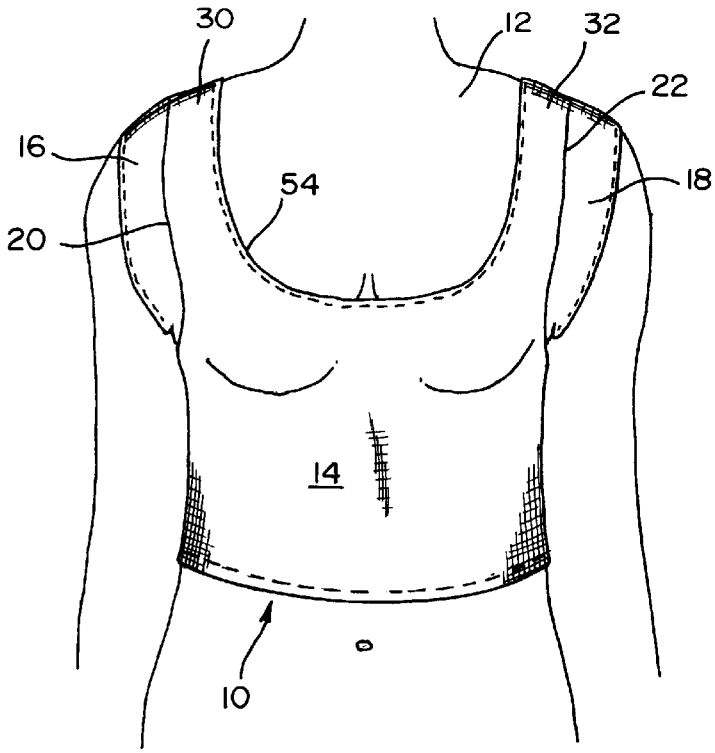
FIG. 4 is a view like FIG. 3, but showing the arms moved down to the person's sides.
Figure 5:
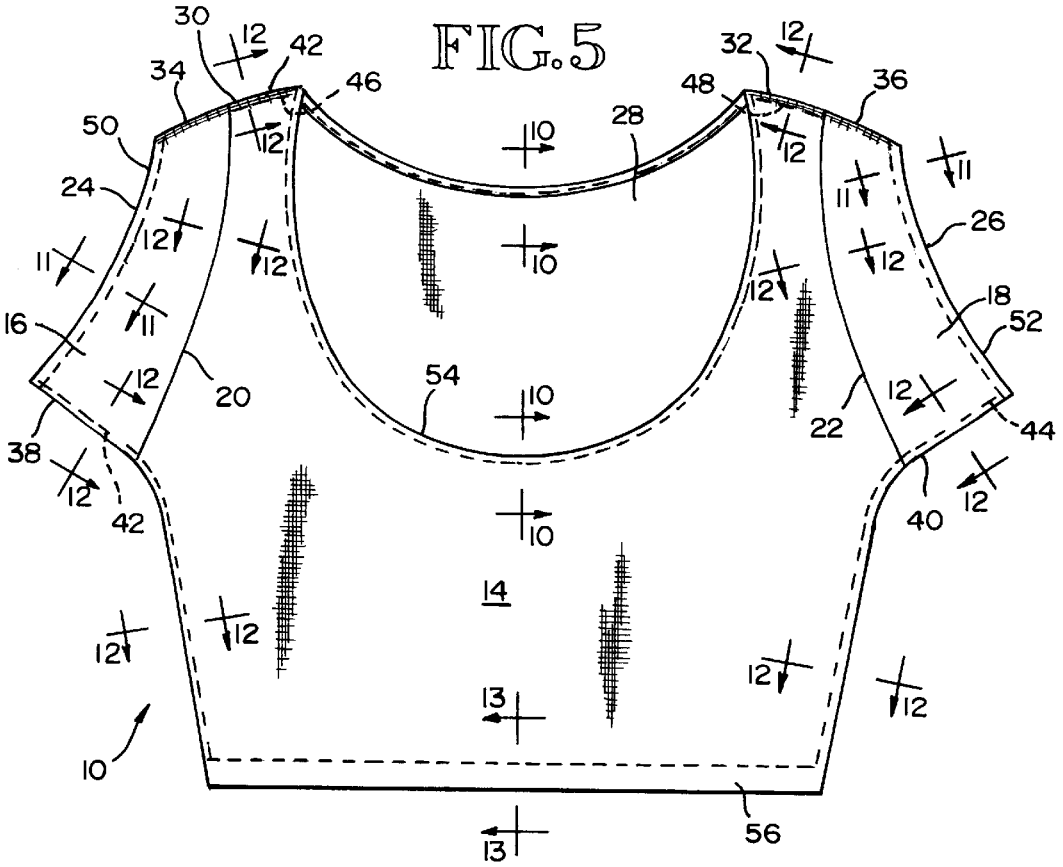
FIG. 5 is a front view of the T-shirt shown in FIGS. 1–4, in a flat condition.
Figure 6:
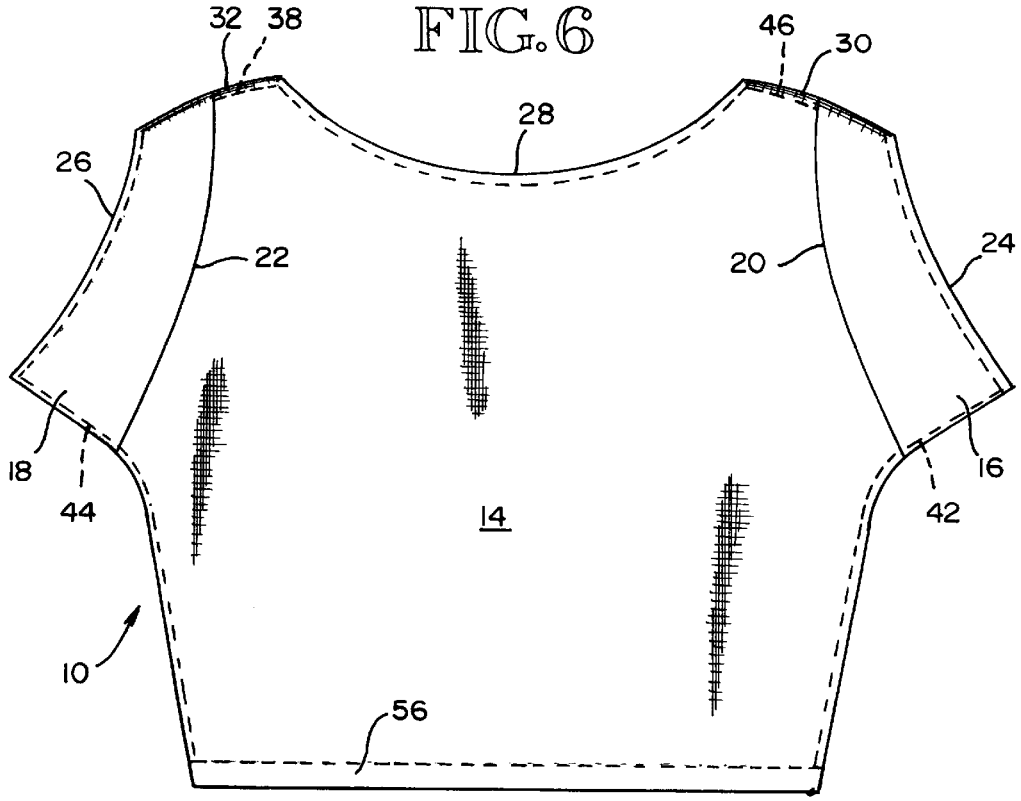
FIG. 6 is a rear elevational view of the T-shirt shown by FIGS. 1–5 also in a flat condition.

Referring to FIG. 7, the region of the shirt 10 that lies between the sleeve seams 20, 22 and the neckline 54 may be compared to the "straps" of a tank top. Accordingly, herein these portions of the shirt 10 may be referred to as the strap portions. At their tops 30, 32, these strap portions have a strap width SW. This width SW can vary from substantially about one and three-fourths inches (1¾") to substantially about three and one-half inches (3½"). An important relationship to the shirt of the present invention is that the torso top regions 30, 32 and the top portions of the sleeve 16, 18 slope downwardly from horizontal as they extend outwardly and they are made to follow and conform to the collar bone and adjoining shoulder regions of the wearer, as shown in FIG. 4. Preferably the tops of the sleeves 16, 18 slope and/or curve downwardly from the tops of the straps 30, 32, as shown in FIGS. 5–8. It is also important that the seams 20, 22 and the outer edges of the sleeves 16, 18 curve in the manner shown by FIGS. 5–8. It is further important that the lower portions of the sleeves 16, 18 slope upwardly as they extend outwardly, as shown by FIGS. 5–8. As a result of this construction, the sleeves 16, 18 will be positioned substantially as shown in FIG. 3 when the wearer holds her arms nearly straight outwardly from her body. When she drops her arms, the lower portions of the sleeves 16, 18 will fold into the underarm regions and provide cloth against both the torso and the arms blocking skin-to-skin contact. The outer edges of the sleeves will curve inwardly as they extend downwardly. The strap tops 30, 32 and the sleeve tops will be positioned against the skin on the shoulder blade and inner shoulder regions of the torso. A blouse, sweater, or other outer garment, can now be placed over the shirt 10. For most such garments, the sleeves 16, 18 will be concealed from sight even if the outer garment has short sleeves. Also, the neckline 54 of the shirt 10 is within the neckline of the outer garment, even if the neckline of the outer garment is relatively wide and deep. The strap regions hide bra straps.

Figure 9:
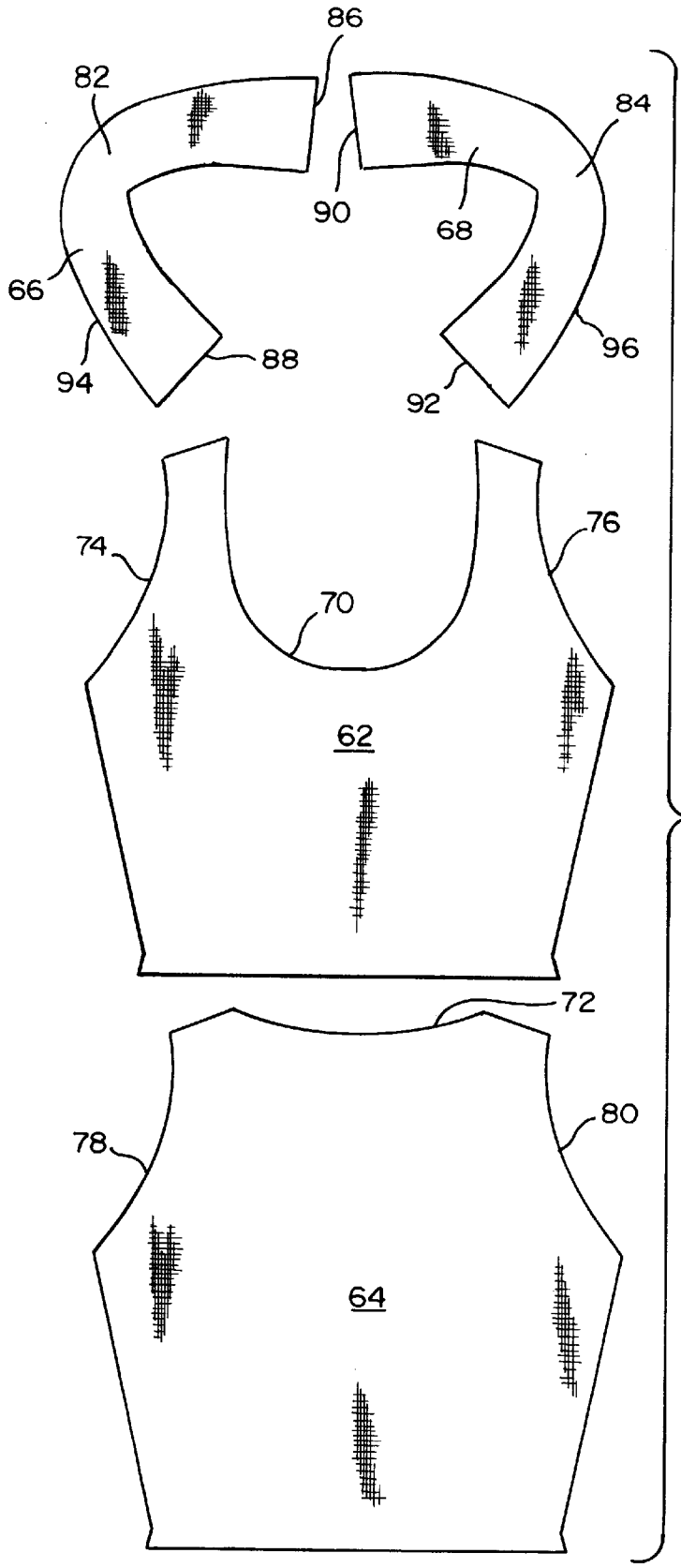
FIG. 9 is a pattern view of the T-shirt shown by FIGS. 1–8, such view showing the T-shirt being made from four pieces.

Referring to FIG. 9, the shirt 10 can be constructed from four pieces of fabric: a front piece 62, a rear piece 64, a first sleeve piece 66 and a second sleeve piece 68. Front piece 62 includes a front neckline cut 70. Neck piece 64 includes a rear neck piece cut 72. Front piece 62 includes sleeve cuts 74, 76 and rear piece 64 includes sleeve cuts 78, 80. The sleeve pieces 66, 68 are substantially U-shaped. They are folded at center regions 82, 84 to form the tops of the sleeves 16, 18. This folding brings end edges 86, 88 of sleeve piece 66 together to form the lower portion of the sleeve, including the seams 42, 44. In like fashion, the folding of sleeve piece 68 brings its end edges 90, 92 together to form sleeve bottom 40. Edge 94 of sleeve piece 66 is sewn to the sleeve cuts 74, 76 and sleeve edge 96 is sewn to the sleeve cuts 76, 80.

The shirt body can be made from polyester, rayon, spandex, lace, silk or cotton blends. Preferably, however, the fabric used for all four pieces 62, 64, 66, 68 is 100% combed cotton, ring spun jersey. Preferably, it is a twenty-eight (28) cut ring spun jersey. Preferably, the sleeve fabric pieces 66, 68 are always made from 100% combed cotton.

FIG. 10 is a cross-sectional view of the neck seam 54. The fabric pieces 62, 64 are turned inwardly and are stitched together at 100 by a suitable stitch that will be attractive and provide the desired amount of stretch at the neck. The sleeve hems 50, 52 are formed in a similar manner. The sleeve pieces 66, 68 are turned inwardly and are stitched together at 102, using a suitable hem stitch. The seams 20, 22, 30, 32 are formed by sewing the sleeve pieces 66, 68 to the front and back pieces 62, 64 while the shirt 10 is in an inside out condition. A suitable seam stitch is provided at 104. Hem 56 is provided by turning the lower edges of the pieces 62, 64 inwardly on themselves and providing a hem stitch at 106 that will stretch with the fabric a suitable amount. The hems and the seams are not novel per se but the construction of hems 100 and 56 is a critical part of the present invention. It is a part of the invention to use for the neck seam 54 a stitching that is durable and which prevents the neck seam 54 from stretching out of shape and puckering, even on shirts having wide U-shaped neck openings 28. Thus, the seam 54 is preferably a serge stitch, folded over once and then sewn with a single needle stitch. This provides a stitch that is durable and prevents a neck seam 54 from stretching out of shape and puckering. See, for example, the serge stitches disclosed in the PFAFF brochure entitled Coverlock 4852.

The waist seam stitch is also critical. It must be formed by double needle cover-stitch and a stretch stitch, or an equivalent stitch or stitch combination. It must allow the shirt 14 to pull over the body easily without breaking the waist seam 56. As previously stated, the torso enclosure is closely contoured to a women's torso shape. This results in a bottom opening that must be stretched when the shirt 10 is being put on and taken off from the wearer 12.

Figure 14:
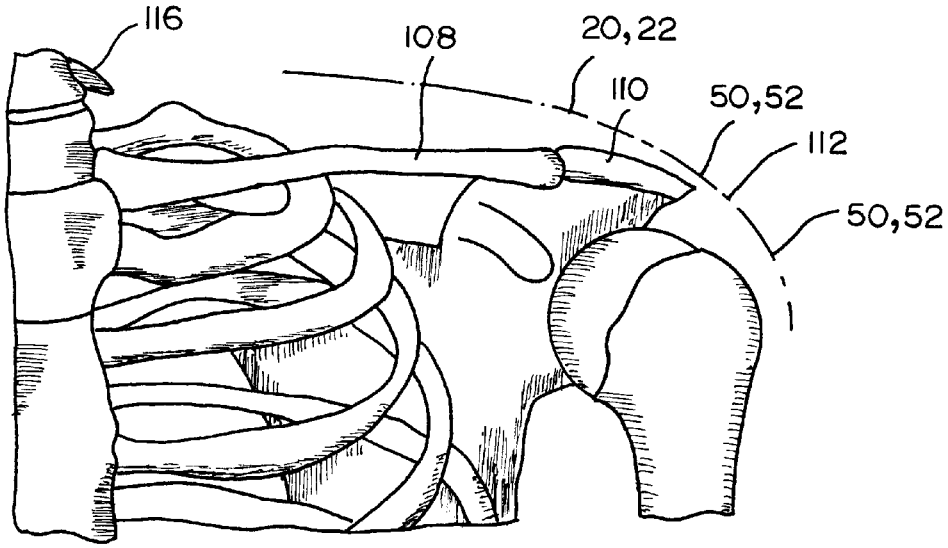
FIG. 14 is a front skeletal view showing the region of the sleeve seam.
Figure 15:
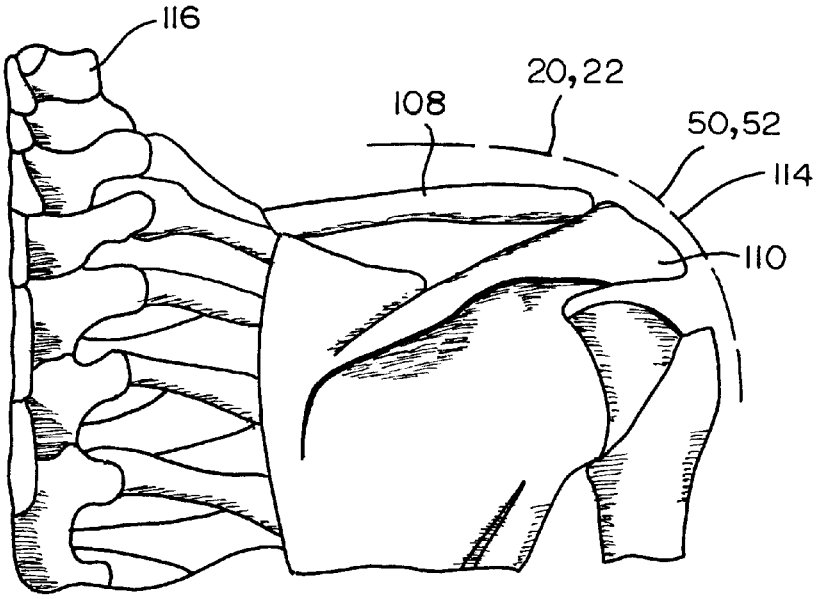
FIG. 15 is a rear skeletal view showing the region of the sleeve seam.

Referring to FIGS. 14 and 15, the clavicle and acromin regions are designated 108, 110. The seams 20, 22 extend over these regions 108, 110, inwardly of the round of the shoulder 112, 114, towards the neck 116. The clavicle/acromin regions may also be referred to as the collar bone region. The outer edge boundaries 50, 52 of the sleeves 16, 18 are positioned on the round of the shoulder. It is important that the top lengths TL of the sleeves 16, 18 be short enough to keep the top regions 34, 36 of the sleeves 16, 18 on the round of the shoulder 112, 114.

Figure 16:
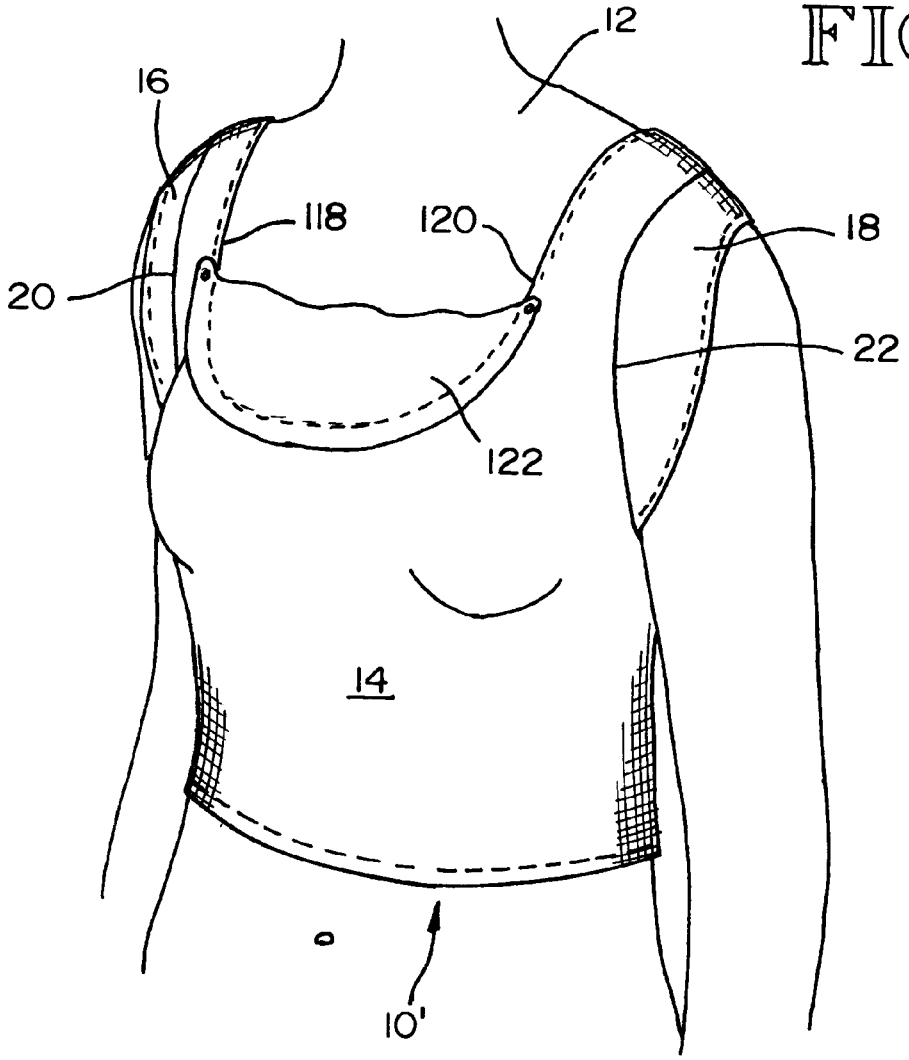
FIG. 16 is a view like FIG. 1, but showing a bib inset added to the T-shirt in the front neckline region.

FIG. 16 shows a modified construction of the shirt 10'. This embodiment includes fasteners 118, 120 that are on the strap regions to which a bib insert 122 may be secured. Fasteners 118, 120 may comprise snap connectors or hook and eye connectors (e.g. Velcro®. An important part of the present invention is that the sleeves 16, 18 and the portions of the torso enclosure 14 that directly border the sleeves 16, 18 function to absorb perspiration and provide a protective shield for an outer garment if the shirt 10 is used as an undershirt. In most cases, the shirt 10 will provide sufficient protection and additional protection is not needed. However, it is also within the scope of the present invention to use the sleeves 16, 18 and the adjoining portions of the torso enclosure 14 to mount standard underarm shields. When used, the shields can be stitched to the fabric of the shirt 10 or, suitable fasteners can be used for fastening the shields to the shirt 10.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A woman's T-shirt, comprising:

a fabric torso enclosure having a top, a neck opening in the top, a bottom including a waist opening, and a pair of arm openings at upper side locations;

a pair of fabric sleeves, each having inner and outer end openings;

seams connecting the inner end openings of the sleeves to the torso enclosure at the arm openings;

wherein said seams are positioned to extend over the clavicle/acromin regions of a wearer of the shirt;

wherein each sleeve has a top length, measured from the seam to the sleeve outer end opening at the top of the sleeve, and a bottom length, measured from the seam to the sleeve outer end opening at the bottom of the sleeve;

wherein said bottom length is longer than the top length; and wherein said sleeves provide perspiration absorbing fabric contiguous both armpits of the wearer.

2. The T-shirt of claim 1, wherein the sleeve top length is about 0–3 inches.

3. The T-shirt of claim 2, wherein the sleeve bottom length is about 3–6 inches.

4. The T-shirt of claim 1, wherein the sleeve bottom length is about 3–6 inches.

5. The T-shirt of claim 1, wherein said neck opening has a neckline in the front with a drop of about 8–10 inches.

6. The T-shirt of claim 5, wherein said neck opening has a neckline in the back with a drop of about 2–3 inches.

7. The T-shirt of claim 1, wherein said neck opening has a generally U-shaped neckline in the front with a drop of about 8–10 inches.

8. The T-shirt of claim 1, wherein at least the sleeve fabric is 100% combed cotton, ring spun jersey.

9. The T-shirt of claim 8, wherein at least the sleeve fabric is a 28 cut ring spun jersey.

10. The T-shirt of claim 1, wherein the width of the top between each seam and the neck opening, on each side of the neck opening, is about 1.25–1.75 inches.

11. The T-shirt of claim 1, wherein the top length of the sleeves is about 0–3 inches, the bottom length of the sleeves is about 3–6 inches, and the neck opening has a neckline in the front with a drop of about 8–10 inches.

12. The T-shirt of claim 11, wherein the neck opening in the top has a hem that includes a durable stitch that prevents the neck hem from stretching out of shape and puckering.

13. The T-shirt of claim 1, wherein the neck opening in the top has a hem that includes a durable stitch that prevents the neck hem from stretching out of shape and puckering.

14. A woman's upper cover, comprising:

a fabric torso enclosure having a top, a neck opening in the top, a bottom including an opening, and a pair of arm openings at upper side locations;

a pair of fabric sleeves, each having inner and outer end openings;

seams connecting the inner end openings of the sleeves to the torso enclosure at the arm openings;

wherein said seams are positioned to extend over the clavicle/acromin regions of a wearer of the shirt;

wherein each sleeve has a top length, measured from the seam to the sleeve outer end opening at the top of the sleeve, and a bottom length, measured from the seam to the sleeve outer end opening at the bottom of the sleeve;

wherein said bottom length is longer than the top length; and wherein said sleeves provide perspiration absorbing fabric contiguous both armpits of the wearer.

15. The upper cover of claim 14, wherein the sleeve top length is about 0–3 inches.

16. The upper cover of claim 15, wherein the sleeve bottom length is about 3–6 inches.

17. The upper cover of claim 14, wherein the sleeve bottom length is about 3–6 inches.

18. The upper cover of claim 14, wherein at least the sleeve fabric is 100% combed cotton, ring spun jersey.

19. The upper cover of claim 14, wherein at least the sleeve fabric is a 28 cut ring spun jersey.

20. The upper cover of claim 14, wherein the neck opening in the top has a hem that includes a durable stitch that prevents the neck hem from stretching out of shape and puckering.

21. The upper cover of claim 14, wherein said upper cover is a women's sports bra.

* * * * *